US005528329A

United States Patent [19]

Sawada et al.

[11] Patent Number: 5,528,329

[45] Date of Patent: Jun. 18, 1996

[54] PHOTOGRAPHIC FILM PROCESSING APPARATUS

[75] Inventors: Ryosaku Sawada; Kensaku Sawada; Kosaku Sawada; Sosaku Sawada; Mikio Matsui, all of Nishinomiya, Japan

[73] Assignee: Hanshin Technical Laboratory, Ltd., Nishinomiya, Japan

[21] Appl. No.: 406,055

[22] Filed: Mar. 17, 1995

Related U.S. Application Data

[63] Continuation-in-part of Ser. No. 241,576, May 12, 1994, Pat. No. 5,426,480.

[30] Foreign Application Priority Data

Jun. 15, 1993 [JP] Japan ..... 5-143678
Aug. 4, 1994 [JP] Japan ..... 6-183545

[51] Int. Cl.[6] ..... G03D 3/08; G03D 13/02

[52] U.S. Cl. ..... 354/320; 354/331; 354/336

[58] Field of Search ..... 354/319–321, 354/324, 331, 336; 134/64 R, 64 P, 122 R, 122 P

[56] References Cited

U.S. PATENT DOCUMENTS

| | | | |
|---|---|---|---|
| 3,057,282 | 10/1962 | Luboschez | 354/331 X |
| 3,277,810 | 10/1966 | Hersh | 134/64 P |
| 3,881,445 | 5/1975 | Nothiger | 118/405 X |
| 4,187,023 | 2/1980 | Schausberger et al. | 354/321 |
| 4,324,479 | 4/1982 | Sachs | 354/319 |
| 4,724,856 | 2/1988 | Pender | 134/122 R |
| 4,987,438 | 1/1991 | Goto et al. | 354/319 |
| 5,182,593 | 1/1993 | Fischer | 354/322 |

FOREIGN PATENT DOCUMENTS

| | | | |
|---|---|---|---|
| 462657 | 10/1992 | Japan . | |
| 462658 | 10/1992 | Japan . | |
| 5188559 | 7/1993 | Japan . | |
| 5-188559 | 7/1993 | Japan | 354/331 |

*Primary Examiner*—D. Rutledge
*Attorney, Agent, or Firm*—Oblon, Spivak, McClelland, Maier & Neustadt

[57] ABSTRACT

A photographic film processing apparatus having a processing unit placed in a water tank and provided with a plurality of processing chambers each having a comparatively small volume, and capable of uniformly, stably, continuously and quickly processing various types of films including super-high-speed films requiring a plurality of film processing steps requiring different reaction times respectively and color films using small quantities of processing solutions. The processing unit is formed by arranging a plurality of pairs of film conveying rollers at given small intervals along an upward concave arc of a circle, closing spaces between the adjacent pairs of film conveying rollers by pairs of sealing rollers, and disposing a pair of support plates provided with ports on the opposite sides of the rollers respectively so as to define processing chambers of small volumes between the adjacent pairs of film conveying rollers and to be arranged successively along the direction of travel of a film (F). The processing unit is placed in a water tank, the body of each of the rollers is formed of an elastic material, and the support plates are provided with ports opening into the processing chambers respectively.

5 Claims, 7 Drawing Sheets

PHOTOGRAPHIC FILM PROCESSING APPARATUS

This application is a continuation-in-part of application Ser. No. 08/241,576, filed on May 12, 1994 now U.S. Pat. No. 5,426,480.

BACKGROUND OF THE INVENTION

1. Field of the Invention

The present invention relates to a photographic film processing apparatus for developing photographic films and photographic printing paper exposed to light or radioactive rays, such as x-rays in the medical field, the industrial field and the general industrial fields.

2. Discussion of the Related Art

Generally, when taking an object by using an optical photographic film or a radiographic film, and developing the exposed optical photographic or radiographic film (hereinafter referred to simply as "film") for the examination of the photograph or the radiograph of the object at an early stage after taking the photograph or the radiograph of the object in the medical field, the industrial field and the general industrial fields, processing solutions, such as a developing solution, a fixing solution and a developing-and-fixing solution (hereinafter referred to inclusively as "processing solutions") are contained in separate containers respectively, and the exposed film is immersed in the processing solution contained in the container for developing, the film is transported in air to the next container, and then the film is immersed in the processing solution in the next container for fixing. When a large number of films are processed at a time or when the film processing operation is repeated frequently, tanks each having a comparatively large volume and provided with film conveying means, such as film conveying rollers, are used for containing the processing solutions, and the film is conveyed through the successive tanks for continuous processing.

Generally, the processing vessel or the processing tank for containing a processing solution is opened to the atmosphere to feed a film into and to take out the film from the processing vessel or the processing tank. Accordingly, the properties of the processing solution deteriorate naturally with time due to oxidation that occurs in the surface of the processing solution as well as due to repetitive use. Furthermore, the processing solution wetting the components, such as the conveying rollers, of the processing apparatus solidifies in particles by drying or crystallizes in crystals, and the particles or the crystals damage the film. Accordingly, when processing a film by a conventional photographic film processing method, the properties of the processing solutions must be continuously controlled to replenish the processing containers with the processing solutions or to change the processing solutions at the appropriate time, and the components of the processing apparatus wetted with the processing solutions must be frequently cleaned to remove the particles or the crystals.

However, since such control of the processing solutions and maintenance of the processing apparatus are comparatively troublesome, it often happens that unclear images are formed or images are damaged as a consequence of failure in replenishing the processing tanks, changing the processing solutions or cleaning the components of the processing apparatus at the appropriate time. Since the exhausted processing solutions must be disposed of after dilution and naturalization according to relevant laws and regulations, the disposal of a large quantity of waste processing solution requires much time and large cost. Therefore, there has been a demand for a compact photographic film processing apparatus capable of stably processing films by using a comparatively small quantity of a processing solution and of making cleaning work unnecessary or reducing the frequency of cleaning work.

The inventors of the present invention had continuously made efforts in improving the conventional photographic film processing apparatus to meet the foregoing demand, and previously proposed an improved photographic film processing tank in Japanese Patent Nos. 1773397 and 1773398. This previously proposed photographic film processing tank is provided with a film inlet slit and a film outlet slit which are immersed in water to suppress the deterioration of a processing solution contained in the photographic film processing tank due to oxidation, and to prevent the solidification and crystallization of the ingredients of the processing solution due to drying so that the film will not be damaged by the particles or crystals of the ingredients of the processing solution. The inventors incorporated further improvements into this previously proposed photographic film processing tank and proposed a photographic film processing apparatus capable of stably processing films by using a very small quantity of a processing solution and of doing away with troublesome work for supplying and changing a new processing solution and for cleaning the components in Japanese Patent Application No. Hei 4-1721. This previously proposed photographic film processing apparatus is provided with a water tank, and processing vessels each provided with a film inlet slit and a film outlet slit at the opposite ends thereof, having a flat processing chamber and placed in the water tank. A processing solution is supplied into the flat processing chamber so that the processing solution will flow alternately in laterally opposite directions to wet uniformly a film traveling through the processing chamber for developing.

The inventors of the present invention proposed another photographic film processing apparatus developed by incorporating further improvements into this previously proposed photographic film processing apparatus, and proposed the same in Japanese Patent Application Hei. 6-19462 based on the priority of Japanese Patent Application Nos. Hei 5-143678 and Hei 5-143678 prior to this patent application. This photographic film processing apparatus proposed prior to this patent application comprises a water tank, and a processing unit having processing chambers each of a small volume, placed in the water tank, and provided with film conveying rollers. The processing chambers of this photographic film processing apparatus can be sealed even if only the end surfaces of the film conveying rollers are sliding surfaces, and this photographic film processing apparatus is capable of stably increasing the speed of contact (stirring) of the processing solution with the film, of suppressing power consumption and of stably, continuously and quickly carrying out uniform processing by using a very small quantity of the processing solution.

The photographic film processing apparatus proposed in a related patent application is shown in FIGS. 8(*a*) and 8(*b*) by way of example. Referring to FIGS. 8(*a*) and 8(*b*), the photographic film processing apparatus has a water tank 1, and three processing vessels 32 each having a processing chamber 32*a* of a small volume and arranged in the water tank 1 along a film conveying direction in which a film F is conveyed. The processing chamber 32*a* of each processing vessel 32 is defined by disposing two pairs of film conveying rollers 33 and 33' with a given small interval therebetween, closing the space between the top film conveying rollers 33 of the two pairs of film conveying rollers 33 and 33' and the space between the bottom film conveying rollers 33' of the same by a pair of sealing rollers 34 and 34', and placing a pair of support plates 35 and 35' close to the opposite ends of the two pairs of film conveying rollers 33 and 33' and the pair of sealing rollers 34 and 34'. All the processing vessels 32 are supported on the pair of support plates 35 and 35'.

Each processing vessel 32 is immersed in fresh water W contained in the water tank 31 and, as shown in FIG. 8(*b*), a sectional view taken on line A—A in FIG. 8(*a*), has an inlet port 35*a* and an outlet port 35*a'*. The inlet port 35*a* and the outlet port 35*a'* of each processing vessel 32 are connected by tubes 38 to a liquid circulating pump 40 to form a closed circuit, and a small air vent tank 39 is connected to the tube 38. A film guide 36 having a flat slit 36*a* is placed in the processing chamber 32*a* of each processing vessel 32. The film conveyor rollers 33 and 33' are driven for synchronous rotation by a driving spur gear 41 driven for rotation about an axis P by a geared motor 42. A film guide 37 and a duct 43 are disposed on the inlet side and the outlet side, respectively, of the processing unit. Thus, the liquid chambers 32*a* are sealed in a liquid-tight fashion, and the film F is conveyed through the processing vessels 32 along a U-shaped film conveying path.

In this photographic film processing apparatus proposed in the related patent application, a developing solution and a fixing solution are circulated through the first processing vessel 32 and the second processing vessel 32 respectively, fresh water W is circulated through the third processing vessel 32, hot air is blown into the duct 43, and then a film F is passed along the U-shaped path through the processing chambers 32*a* of the processing vessels 32 for successive developing, fixing, washing and drying.

Although the photographic film processing apparatus of the prior patent applications (Japanese Patent Application Nos. 5-143678 and 6-19462) has the aforesaid excellent effects in processing x-ray films and monochromatic films, it was found through minute examination of the photographic film developing apparatus that the following problems to be solved arise in the photographic film processing apparatus when processing superhigh-speed monochromatic films or color films and when processing long normal-speed films at an increased processing speed.

For example, screen films, i.e., normal-speed films using an intensifying screen, which are used generally for x-ray photography in the medical field, require substantially equal times respectively for developing and fixing. Therefore the time ratio between the developing process and the fixing process is 1:1 and the screen films can be processed continuously for developing and fixing.

Nonscreen films, i.e., superhigh-speed films not using any intensifying screen, which have been generally used in the industrial field and have been widely used in recent years for dental x-ray photography at a low exposure, require a fixing time longer than a developing time to increase the quantity of silver, and the time ratio between the developing process and the fixing process is 1:1.5 or above. When continuously processing such a superhigh-speed film by the conventional method, the time ratio between the developing process and the fixing process is 1:1 based on the time required for fixing. If it is desired to process the superhigh-speed film on the basis of the developing time, the time necessary for the superhigh-speed film to pass through the fixing solution must be 1.5 times the time necessary for the same to pass through the developing solution or longer.

The photographic film processing apparatus of the prior 10 patent application conveys the film through the processing vessels of the same length in the same time. Therefore, the fixing solution must be circulated through the second processing vessel at a velocity higher than that at which the developing solution is circulated through the first processing vessel or the respective concentrations of the developing solution and the fixing solution must be adjusted so that the respective speeds of the developing reaction and the fixing reaction are different from each other to process the superhigh-speed film continuously at an increased conveying speed in a reduced time. Similarly, when processing a long normal-speed film, the respective flow speeds and the respective concentrations of the processing solutions circulated through the processing vessels must be adjusted so as to promote the developing reaction and the fixing reaction to reduce the time in which all the length of the long film passes the photographic film processing apparatus by increasing the film conveying speed.

However, when the flow speed of the processing solution is increased, the flow passage resistance increases progressively and power necessary for circulating the processing solution increases accordingly. Furthermore, since the speed of reaction between the processing solution and the photosensitive layer coating the surface of the film is not necessarily promoted in proportion to the concentration and the flow speed of the processing solution even if the concentration and the flow speed of the processing solution are increased beyond fixed limits respectively, the increase of the concentration and the flow speed of the processing solution beyond the limits is useless. Consequently, when processing the superhigh-speed film, the concentration or the flow speed of the developing solution circulated through the first processing vessel must be reduced, which determines a low rate of process. The increase of the speed of conveying the long normal-speed film is limited for the same reason and hence it is difficult to reduce the processing time.

When processing a color film through a series of steps of coupling, stopping, hardening, washing, bleaching, washing, fixing and final washing, washing steps are essential steps between the specific processes. When processing a film by the photographic film processing apparatus of the prior patent application, the film processed by the processing solution flowing through the processing chamber of the processing vessel travels through the water contained in the water tank, and then the film travels into the processing chamber of the next processing vessel and hence the film is washed after being processed in each processing vessel. Therefore, monochromatic films can be processed by the photographic film processing apparatus of the prior patent application without any problem. However, color films are difficult to be stably processed by the photographic film processing apparatus of the related patent application.

Furthermore, when processing a film by the photographic film processing apparatus of the related patent application, in which the film travels from one processing vessel to the subsequent processing vessel through the water contained in the water tank, when the photographic film processing apparatus is operated in a daylight room, the open upper end of the water tank must be covered closely with a hood or the like to shield the water tank perfectly from light in order that the film may not be exposed to light, which is an obstruction to the ease of operation and the formation of the photographic film processing apparatus in a compact construction. In this respect, the photographic film processing apparatus of the related patent application needs improvements.

SUMMARY OF THE INVENTION

The present invention has been made to solve the foregoing problems and it is therefore an object of the present invention to provide a photographic film processing apparatus comprising a water tank, and a processing unit having a plurality of processing chambers and placed in the water tank contained in the water tank; capable of easily shielding a film from light during processing, of properly determining processing times for which the film is processed in processing solutions by specific processes, and of continuously, uniformly, quickly and stably processing long normal-speed films, and films to be processed by a plurality of processes having different reaction times, such as superhigh-speed films and color films by processes using small quantities of processing solutions.

The present invention provides the following to achieve the foregoing objects.

A photographic film processing apparatus of the present invention comprises a water tank, and a processing unit having a plurality of processing chambers of a small volume successively arranged along a film conveying direction, disposed in the water tank and comprising: a plurality of pairs of film conveying rollers arranged at predetermined small intervals; one pair or odd pairs of sealing rollers disposed between the two adjacent pairs of film conveying rollers; the top sealing roller of the pair of sealing rollers or the top sealing rollers of the odd pairs of sealing rollers being arranged so as to connect the respective top film conveying rollers of the two adjacent pairs of film conveying rollers; the bottom sealing roller of the pair of sealing rollers or the bottom sealing rollers of the odd pairs of sealing rollers being arranged so as to connect the respective bottom film conveying rollers of the two adjacent pairs of film conveying rollers; a pair of support plates being disposed on the opposite sides of the pairs of film conveying rollers and the pairs of sealing rollers respectively so as to define the processing chambers of a small volume arranged successively along a film conveying direction together with the pairs of film conveying rollers and the pairs of sealing rollers; the bodies of the film conveying rollers and the sealing rollers being formed of elastic materials; one of the pair of support plates being provided with inlet ports opening into the processing chambers respectively; and the other support plate being provided with ports opening into the processing chambers respectively.

A photographic film processing apparatus of the present invention further includes a film guide member having a flat liquid passage communicating with the inlet port and the outlet port formed in the pair of support plates respectively, one slit facing a contact line between the top film conveying roller and the bottom film conveying roller of one of the two adjacent pairs of film conveying rollers and another slit facing a contact line between the top film conveying roller and the bottom film conveying roller of the other pair of film conveying rollers is disposed in each of the processing chambers so as to be separated form the film conveying rollers and the sealing rollers.

In a photographic film processing apparatus of the present invention, the pairs of film conveying rollers and the pairs of sealing rollers are arranged along a circular line having the shape of an upward concave arc of a circle or a U-shaped line comprising an upward concave arc of a circle and lines tangentially extending from the opposite ends, respectively, of the upward concave arc of a circle, the processing chambers are arranged successively on the circular line or the U-shaped line, the diameter of the top film conveying roller of each pair of film conveying rollers is smaller than that of the bottom film conveying roller of the same pair of film conveying rollers, and the diameter of the top sealing roller of each pair of sealing rollers is smaller than that of the bottom sealing roller of the same pair of sealing rollers.

In a photographic film processing apparatus of the present invention, at least one of the processing chambers of the processing unit is connected to a washing water supply means through the inlet port and a tube connected to the inlet port and to the water tank through the outlet port and a tube connected to the outlet port to form an open circuit, each of the rest of the processing chambers is connected to a circulating pump through the inlet port, a tube connected to the inlet port, the outlet port and a tube connected to the outlet port to form a closed circuit, and a processing solution supply tube and an air vent tank are connected to the tube or the circulating pump.

In the photographic film processing apparatus of the present invention, the circulating pump is disposed near the outlet port of one of the support plates in the water tank, the discharge port of the circulating pump is connected to the outlet port of the other support plate by a tube extended under or around the processing unit, and the suction port of the circulating pump is connected to the outlet port of the former support plate by a tube extended along the shortest route.

In the photographic film processing apparatus of the present invention, since the processing unit comprising the 10 processing chambers each having a small volume, each defined by the two adjacent pairs of film conveying rollers, the pair or the odd pairs of sealing rollers and the pair of support plates provided with the inlet ports and outlet ports opening into the processing chambers, and arranged along the film conveying direction is placed in the water tank, processing solutions supplied from external processing solution sources into the processing chambers flow across the film conveying direction, the film is conveyed by the film conveying rollers so as to travel across the flow of the processing solutions in the processing chambers so that the surface of the film is wetted uniformly by the processing solutions for expected reactions between the processing solutions and the photosensitive layer coating the surface of the film.

Since the bodies of the film conveying rollers and the sealing rollers are formed of elastic materials, the processing chambers defined by the rollers arranged with the other surfaces thereof in close contact with each other and the pair of support plates disposed in close contact directly or through the sealing rings with the opposite ends of the rollers can be sealed in a liquid-tight fashion while the rollers rotates. Since the top and the bottom film conveying roller of each pair of film conveying rollers nip the film therebetween and rotate to convey the film, the film can be surely conveyed through the processing chamber without being scratched and the liquid-tight sealing of the processing chamber can be maintained.

Since the processing unit is placed in the water tank, a leakage of the processing solution from the processing chamber of the processing unit into the water tank can be suppressed by balancing the pressure of the water contained in the water tank and that of the processing solution in the processing chamber, the processing solutions flowing through the processing chambers can perfectly be isolated from the atmosphere to prevent the deterioration of the properties of the processing solutions due to oxidation, and the solidification and/or crystallization of the processing solution that will damage the film can be prevented.

Furthermore, since each processing chamber may be formed in a small sectional area so that the volume thereof is very small within a range allowing the passage of the film therethrough and the transverse flow of the processing solution, each processing chamber can be filled up with a small quantity of the processing solution, the velocity of the transverse flow of the processing solution can be easily increased and, consequently, the speed of contact (stirring speed) of the processing solution with the film passing through the processing chamber can be increased to enable uniform, stable, quick processing by using a small quantity of the processing solution.

Since each processing chamber of the processing unit is provided with a pair of sealing rollers or odd pairs of sealing rollers, the sealing rollers can be easily driven for rotation in directions conforming to the directions of rotation of the two adjacent pairs of film conveying rollers synchronously with the rotation of the two adjacent pairs of film conveying rollers by the two adjacent pairs of film conveying rollers. The processing chamber formed between the two adjacent, specified pairs of film conveying rollers disposed at a specified position can be formed in a length along the film conveying direction greater than those of the rest of the processing chambers by arranging an increased number of pairs of scaling rollers greater than the numbers of pairs of sealing rollers arranged between the rest of the pairs of film conveying rollers between the two adjacent, specified pair of film conveying rollers.

Furthermore, since each of the two adjacent pairs of film conveying rollers forming each processing chamber is used for defining the two adjacent processing chambers, and the successive processing chambers, unlike the successive processing chambers of the photographic film processing apparatus of the invention of the aforesaid related patent application, are not separated from each other by the water contained in the water tank, the same processing solution can be supplied to the plurality of processing chambers contiguously arranged at specified positions respectively to carry out processes using the same processing solution in the plurality of contiguously arranged processing chambers.

Accordingly, the residence time in the same processing solution in each of the successive processes can be properly determined by using the combination of those and, consequently, various types of films requiring a plurality of processes of different processing times can be continuously and quickly processed for development at a high film conveying speed without increasing the concentration and the flow speed of the processing solution in specified processing chambers beyond given limits.

The photographic film processing apparatus having the successively arranged processing chambers needs to shield the film from light only on the film feed side and is capable of perfectly shielding the film from light in process. Therefore, the photographic film processing apparatus is able to carry out a film developing process in daylight.

In the photographic film processing apparatus of the present invention, since the film guide member disposed in each processing chamber of the processing unit forms a flow passage for the processing solution and a film passage for the film, and reduces the effective volume of the processing chamber, the film is able to travel stably through the processing chamber, the flow of the processing solution is straightened, the flow speed of the processing solution is increased to wet the surface of the film traveling through the processing chamber surely and uniformly by the processing solution and to increase the contact speed (stirring speed), and the film can be processed uniformly, stably, continuously and quickly.

In the photographic film processing apparatus of the present invention, the processing chambers of the processing unit are arranged along the circular line having the shape of an upward concave arc of a circle or the U-shaped line comprising an upward concave arc of a circle and lines tangentially extending from the opposite ends, respectively, of the upward concave arc of a circle, and the film can be conveyed continuously along a substantially U-shaped path, i.e., the film can be fed downward and delivered upward, a long film can be easily processed and the photographic film processing apparatus has a comparatively small length and a compact construction. Furthermore, since the diameter of the top film conveying roller of each pair of film conveyor rollers is smaller than that of the bottom film conveying roller, and the diameter of the top sealing roller of each pair of sealing rollers is smaller than that of the bottom sealing roller, the rollers can be easily arranged along the circular line or the U-shaped line, and the film can be easily and stably conveyed.

In the photographic film processing apparatus of the present invention, since at least one of the processing chambers is connected to the fresh water supply means and opened into the water tank to form an open circuit, and each of the rest of the processing chambers is connected to the circulating pump by the tubes to form a closed circuit, a fixed small quantity of the processing solution is circulated through the processing chamber so that the processing solution will flow across the film conveying direction for processing, and water is supplied continuously through the processing chamber included in the open circuit into the water tank to wash the processed film. Since the processing solution supply tube and the air vent tank are connected to the tube forming the closed circuit or the circulating pump included in the closed circuit, the processing solution can be supplied to the closed circuit and the closed circuit can be replenished with the processing solution whenever necessary, and air unavoidably mixed in the processing solution, the closed circuit when filling up or replenishing the closed circuit with the processing solution can be discharged through the air vent tank to prevent the reduction of the accuracy of the process due to bubbles contained in the processing solution.

In the photographic film processing apparatus of the present invention, since each circulating pump is disposed near the processing unit in the water tank, the circulating pump can be connected to the corresponding processing chamber of the processing unit by a comparatively short tube, the flow passage resistance of the closed circuit is comparatively low, the processing solution can be circulated by comparatively low power, and, even if the processing solution leaks from the joints between the circulating pump and the tubes, the processing solution disperses in the water contained in the water tank, so that the processing solution will not flow outside the photographic film processing apparatus and will not wet things around the photographic film processing apparatus.

Since the tube connecting the suction port of each circulating pump to the outlet port of the corresponding processing chamber is extended along the shortest route, the resistance of the return passage is lower than that of the feed passage and hence the processing solution is circulated in a suction mode, so that the leakage of the processing solution from the processing chamber due to rise in the pressure in the processing chamber can be prevented.

The processing solutions are solutions generally used for processing ordinary films, such as a developing solution, a fixing solution, a developing-and-fixing solution, a color developing solution, a stopping solution, a hardening solution, a bleaching solution, a stabilizing solution, an after-treatment solution and such, solutions for processing color films, and fresh water for washing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is a sectional view taken on line A—A in FIG.

FIG. 5(*b*) is a view of assistance in explaining a liquid supply system included in the photographic film processing apparatus in the third embodiment;

DESCRIPTION OF THE PREFERRED EMBODIMENTS

Figure 1A:
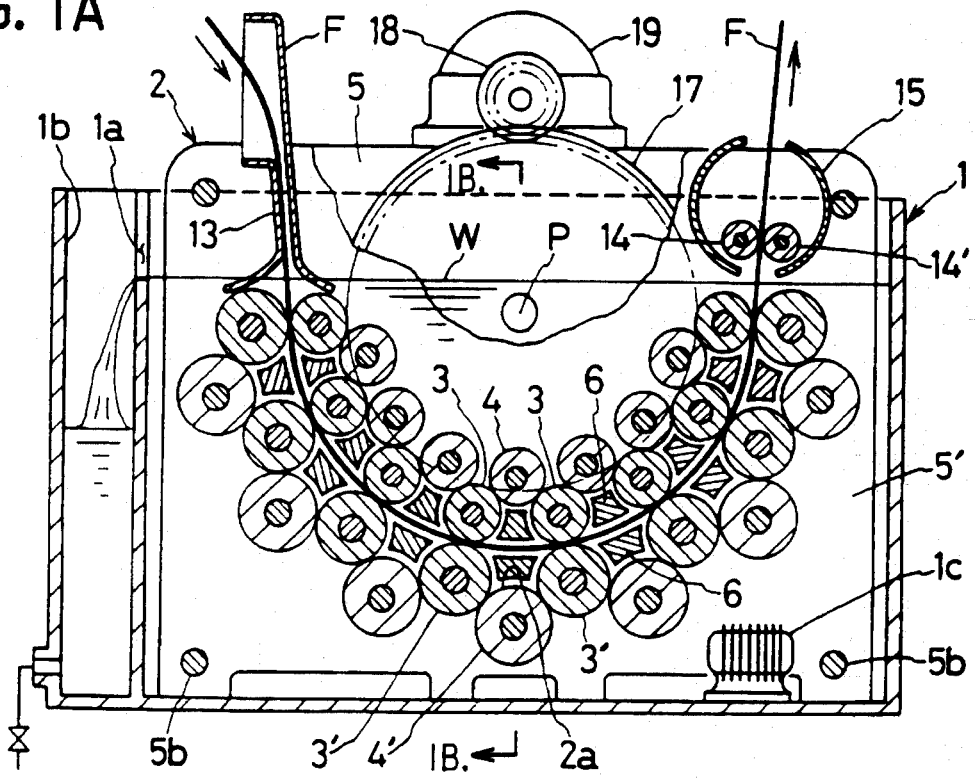
FIG. 1(*a*) is a partly cutaway front view of a photographic film processing apparatus in a first embodiment according to the present invention.
Figure 1B:
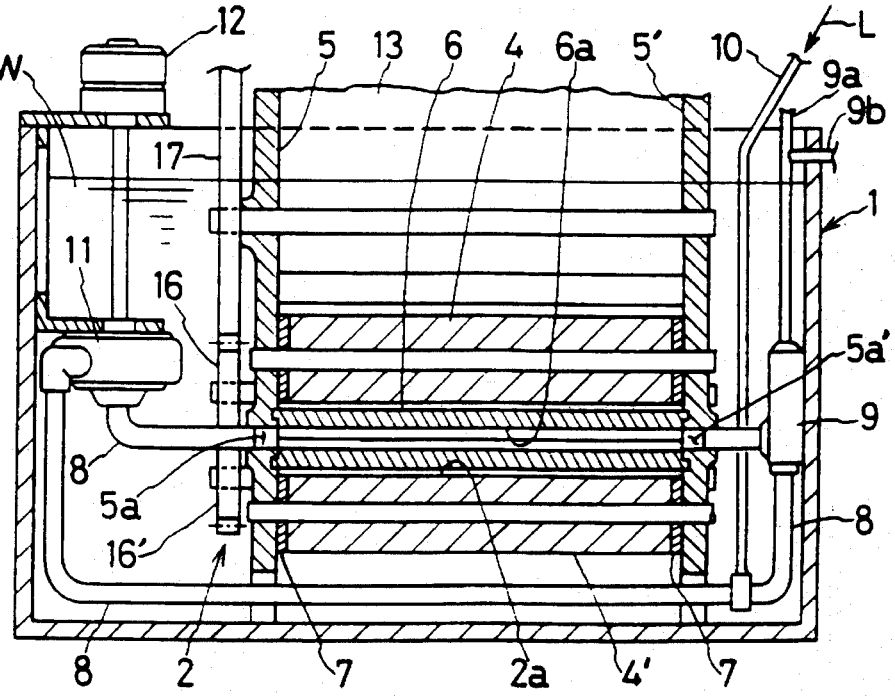

Referring now to the drawings, wherein like reference numerals designate identical or corresponding parts throughout the several views, and more particularly to FIGS. 1(*a*) and 1(*b*), a water tank 1, which is a cubic tank opening upward, is divided into a drain chamber 1*b* and a water chamber with a partition wall provided with an overflow hole 1*a* for limiting the level of the surface of the water contained in the water chamber of the water tank 1. A temperature regulator 1*c* is placed in the water tank 1 on the bottom wall of the same.

A processing unit 2 comprises eight pairs of film conveying rollers 3 and 3' arranged at given small intervals on an upward concave arc of a circle having its center at a center point P. A pair of sealing rollers 4 and 4' are disposed between the two adjacent pairs of film conveying rollers 3 and 3' so that the top sealing roller 4 is in contact with both the top film conveying rollers 3 of the two adjacent pairs of film conveying rollers 3 and 3' and the bottom sealing roller 4' is in contact with both the bottom film conveying rollers 3' of the two adjacent pairs of film conveying rollers 3 and 3', and a pair of support plates 5 and 5' are disposed in contact with the opposite ends of the film conveying rollers 3 and 3' and the sealing rollers 4 and 4' respectively, to define seven processing chambers 2*a*, i.e., processing chambers No. 1 to No. 7, of a small volume arranged contiguously along the direction of travel of a film F on the arc of the circle.

The diameter of the top film conveying rollers 3 is smaller than that of the bottom film conveying rollers 3' and the diameter of the top sealing rollers 4 is smaller than that of the bottom sealing rollers 4' so that the rollers can easily be arranged along the arc of the circle and the film F can easily be conveyed.

As shown in FIG. 1(*b*), the support plates 5 and 5' are provided with ports 5*a* and 5a' opening into the processing chambers 2*a* respectively.

Each of the film conveying rollers 3 and 3' and the sealing rollers 4 and 4' is a flat rubber roller formed by bonding a rubber body to a metallic shaft. The opposite ends of the shafts of the film conveying rollers 3 and 3' and the sealing rollers 4 and 4' extend through and project outside from and are journaled for rotation on the support plates 5 and 5' respectively. As shown in FIG. 1(*b*), flat sealing rings 7 of diameters equal to those of the bodies of the rollers 3, 3', 4 and 4' each formed by attaching a Teflon sheet having a low frictional property to a silicone rubber plate are interposed between the opposite ends of the rubber bodies of the film conveying rollers 3 and 3' and the sealing rollers 4 and 4' and the inner surfaces of the support plates and 5' respectively, to seal gaps between the opposite ends of the rubber bodies and the support plates 5 and 5' in a liquid-tight fashion so that the rollers 3, 3', 4 and 4' are able to rotate relative to the support plates 5 and 5'. The support plates 5 and 5' are disposed in parallel to each other and joined together at the corresponding four corners thereof by stay rods 5*b* to form an assembly of the support plates 5 and 5' and the rollers.

A film guide member 6 is placed in each processing chamber 2*a* and is held at its opposite ends on the support plates 5 and 5' so as to be spaced apart from the feed rollers 3 and 3' and the sealing rollers 4 and 4'. The film guide member 6 has a flat liquid passage 6*a* having an inlet end and an outlet end having the shape of a slit, and connected to the part 5*a* of the support plate 5 and the port 5*a'* of the support plate 5'. The film guide member 6 is formed of a polyvinyl chloride resin by extrusion molding and has laterally elongate circular recesses conforming to the circumferences of the film conveying rollers 3 and 3' and the sealing rollers 4 and 4' respectively.

A film guide duct 13 has walls defining a flat film passage for guiding the film F and inner surfaces coated with black Teflon, and a flared outlet end. The film guide duct 13 is supported at its opposite sides on the support plates 5 and 5' with the flared outlet end closely covering and conforming to the circumferences of the pair of film conveying rollers 3 and 3' of the foremost processing chamber of the processing unit 2. The film guide duct 13 is provided in its upper end with a vertical, rectangular opening to receive a film loading dark box or a film cartridge, not shown, closely therein.

Furthermore, an air duct 15 having an inlet slit and an outlet slit through which the film F travels, and internally provided with a pair of dewatering rollers 14 and 14' near the inlet slit is extended across the direction of travel of the film F above the pair of film conveying rollers 3 and 3' of the last processing chamber and is held at its opposite ends on the support plates 5 and 5'. A hot air blower 20, not shown, is connected to the open end of the air duct 15 to blow hot air against the pair of dewatering rollers 14 and 14'. Consequently, water wetting the pair of dewatering rollers 14 and 14' can readily be removed, and the dewatering and drying of the film are promoted. The hot air blown into the air duct 15 flows outside through the outlet slit.

The processing unit 2 is placed in the water tank 1 so that the uppermost sealing roller 4 is positioned slightly beneath the regulated level of the surface of the water W contained in the water tank 1, the processing chambers 2*a* are immersed completely in the water W, and the upper end of the film guide duct 13 provided with the rectangular opening and the air duct 16 are above the regulated level of the surface of the water W. As shown in FIG. 1(*b*), the ports 5*a* and 5*a'* opening into each of the five processing chambers 2*a* excluding the processing chambers No. 3 and No. 7 among the seven processing chambers 2*a* are connected by a rubber return tube 8 and a rubber feed tube 8 to a centrifugal circulating pump 11 placed in the water tank 1 so that the processing chamber 2*a*, the tubes 8 and the circulating pump 11 form a closed circuit.

Each circulating pump 11 is disposed near the port 5*a* of the corresponding processing chamber 2*a* of the processing unit 2, and is driven by a variable-speed motor 12 disposed above the regulated level of the surface of the water W. The discharge port of the circulating pump 11 is connected to the port 5*a'* by the return tube 8 and the suction port of the circulating pump 11 is connected to the port 5*a* by the return tube 8 having the least possible length, so that the flow passage resistance of the return tube 8 is lower than that of the feed tube 8. A rubber liquid supply tube 10 is connected to the comparatively long feed tube 8 for the initial supply of a processing solution L to fill up the closed circuit with the processing solution L before starting the film processing operation and to replenish the closed circuit with the processing solution L, and a small air vent tank 9 is interposed between the upper end of the feed tube 8 and the port 5*a'*.

An overflow tube 9*b* is connected to an air vent tube 9*a* connected to the air vent tank 9 at a position above the surface of the water W. The overflow tube 9*b* is connected by a transparent tube, not shown, to the drain chamber 1*c* of the water tank 1. The liquid supply tube 10 is connected to a scaled processing solution supply unit, not shown.

Figure 2:
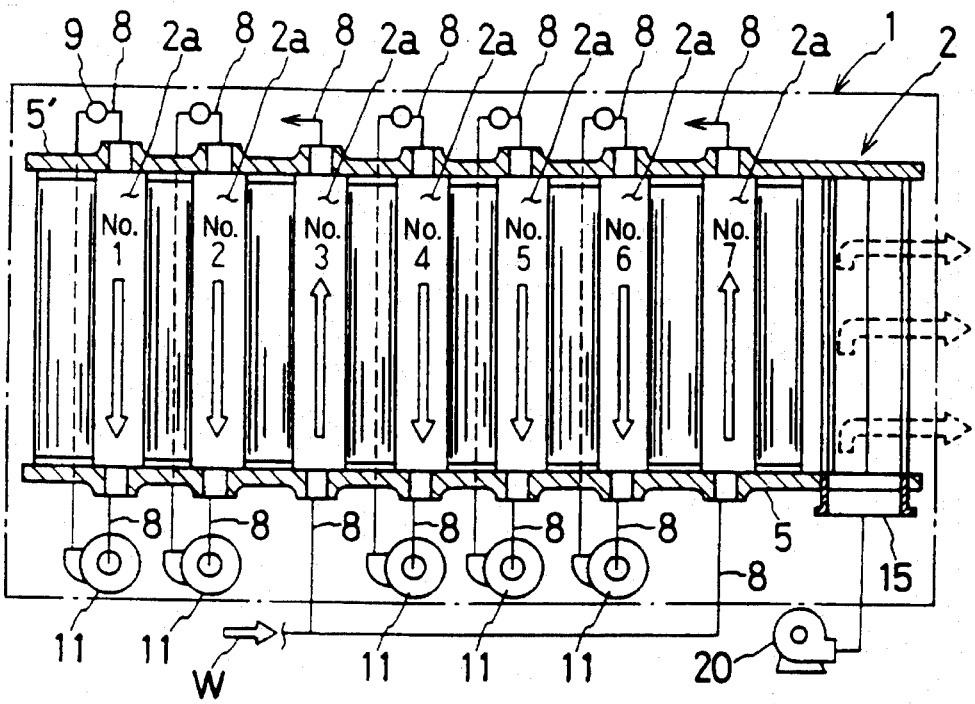
FIG. 2 is a schematic view of assistance in explaining a processing liquid supply system included in the photographic film processing apparatus in the first embodiment.

The five processing chambers 2*a*, namely, the processing chambers Nos. 1, 2, 4, 5 and 6, form independent closed circuits respectively, as shown in FIG. 2. Each of the processing chambers Nos. 3 and 7 is connected to a water supply means, not shown, by a feed tube 8 connected to the port 5*a* of the support plate 5 and communicates with the interior of the water tank 1 by means of a return tube 8 connected to the port 5*a'* of the other support plate 5 to form an open circuit. The processing solutions L are circulated through the five processing chambers 2*a* Nos. 1, 2, 4, 5 and 6, and water W is supplied continuously through the processing chambers 2*a* Nos. 3 and 7 into the water tank. Hot air is supplied to the air duct 15 by the hot air blower 20 disposed outside the water tank 1.

A driving spur gear 17 is journaled for rotation about an axis P on the support plates 5 and 5' of the processing unit 2.

Figure 3:
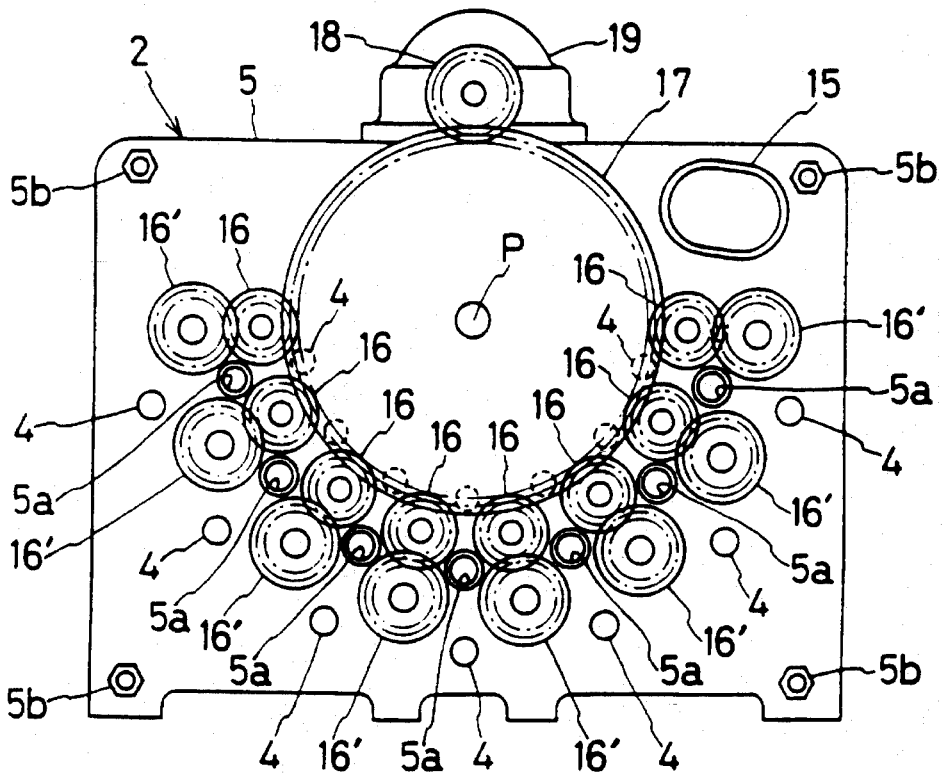
FIG. 3 is a view of assistance in explaining a driving system included in the photographic film processing apparatus in the first embodiment.

Referring to FIG. 3, the driving spur gear 17 is in engagement with a pinion 18 mounted on the output shaft of a geared motor 19 mounted on the support plates 5 and 5', and with spur gears 16 each mounted on one end of the shaft of the top film conveying roller 3 and in engagement with a spur gear 16' mounted on one end of the shaft of the corresponding bottom film conveying roller 3'. This driving system drives the eight pairs of film conveying rollers 3 and 3' synchronously by the single geared motor 19. The sealing rollers 4 and 4' are free rollers which are frictionally driven for rotation by the associated pairs of film conveying rollers 3 and 3'.

In this photographic film processing apparatus, first fresh water W is supplied continuously to the two processing chambers 2*a* Nos. 3 and 7 to supply fresh water W into the water tank 1 so that the processing chambers 2*a* of the processing unit 2 are immersed in the water W.

Then, the processing solutions L are supplied through the liquid supply tubes 10 to fill up the five closed circuits including the five processing chambers 2*a* Nos. 1, 2, 4, 5 and 6 respectively. The processing solutions L supplied to the two adjacent processing chambers 2*a* Nos. 1 and 2 are the same developing solution, and the processing solutions L supplied to the three processing chambers 2*a* Nos. 4, 5 and 6 are the same fixing solution.

Then, the geared motor 19 is started to rotate the rollers of the processing unit 2 and the variable-speed motors 12 are started to circulate the processing solutions L filling up the closed circuit at high rates through the processing chambers 2*a* by driving the circulating pumps 11. The processing solutions L are trickled through the liquid supply tubes 10 observing the air venting condition of the air vent tanks 9 to deaerate the closed circuits completely. After the closed circuits have completely been deaerated, hot air is supplied into the air duct 15, the film F is inserted in the film guide duct 13, the film F is conveyed through the seven processing chambers 2*a* along the U-shaped path by the eight pairs of film conveying rollers 3 and 3' to process the film F continuously for developing, intermediate washing, fixing, final washing and drying.

In the photographic film processing apparatus in this embodiment, since the film travels across the flows of the processing solutions flowing through the processing chambers, the surface of the film can be uniformly wetted with the processing solutions to cause expected reactions between a photosensitive layer coating the surface of the film and the processing solutions satisfactorily. Each film guide member disposed in each processing chamber forms passages of predetermined shapes for the processing solution and the film and reduces the volume of the processing chamber, the film travels stably through the processing chamber, the flow of the processing solution is straightened, the velocity of the flow of the processing solution is increased, the processing solution is able to wet the surface of the traveling film surely and uniformly and the contact speed (stirring speed) can be increased.

Furthermore, generation of bubbles in the processing solution flowing through the processing chamber at a high flow speed can be prevented by removing air unavoidably let into the closed circuit including the processing chamber by the air vent tank when supplying the processing solution to the closed circuit and when replenishing the closed circuit with the processing solution. Accordingly, the film can be stably, continuously and quickly processed by using small quantities of the processing solutions.

Since the developing solution is supplied to the two adjacent processing chambers Nos. 1 and 2, and the fixing solution is supplied to the three processing chambers Nos. 4, 5 and 6, the ratio in the duration of travel of the film traveling at a fixed speed through the developing solution and the fixing solution is 1:1.5, and the film travels a comparatively long distance through the developing solution and a comparatively long distance through the fixing solution. Therefore, a long superhigh-speed film requiring a fixing time about 1.5 times the developing time can be stably processed even if the film is conveyed at an increased conveying speed and the respective concentrations and the respective flow speeds of the developing solution and the fixing solution are not increased beyond given limits.

Since the bodies of the rollers are formed of rubber, the liquid-tight contact between the rollers can be maintained even while the rollers are rotating, and the liquid-tight sealing between the opposite ends of the rollers and the support plates can be maintained by the sealing rings interposed between the opposite ends of the rollers and the support plates. Since the pairs of film conveying rollers rotate nipping the film therebetween, the film can be surely conveyed through the processing chambers without being abraded and the liquid-tight sealing of the processing chambers can be maintained. Since the opposite ends of the bodies of the rollers are only sliding surfaces and the sealing rings having a low frictional property are interposed between the sliding surfaces and the support plates, only a low frictional resistance acts on the rotating rollers, so that the film processing operation of the photographic film processing apparatus requires a comparatively small power.

Since the processing chambers are immersed in the water contained in the water tank, the pressure of the water balances the internal pressures of the processing chambers to suppress the leakage of the processing solutions from the processing chambers. Since the suction side of each circulating pump is connected to the return side of each processing chamber by the shortest possible return tube, and the resistance of the return tube to the flow of the processing solution is lower than that of the feed tube, the processing solution is caused to flow through the processing chamber in a suction mode as indicated by a blank arrow in FIG. 2, so that the leakage of the processing solution from the processing chamber due to increase in the internal pressure of the processing chamber can be surely suppressed.

Since a very small quantity of the processing solution taken out from the processing chamber by the rotating rollers disperses in and is autonomously diluted by the water contained in the water tank and the diluted processing solution spills into the drain chamber. The waste water contained in the drain chamber can be treated with a neutralizing agent into waste water of properties conforming to effluent standards specified in the relevant laws and regulations. Since the circulating pumps are immersed in the water contained in the water tank, the processing solutions contained in the closed circuits including the processing chambers are perfectly isolated from the atmosphere and thereby the deterioration of the processing solutions due to oxidation, and the solidification and crystallization of the processing solutions on the rollers of the processing unit and resultant damage to the processed film caused by particles and crystals of the processing solutions can be surely prevented.

Furthermore, since the circulating pumps are disposed close to the processing unit placed in the water tank, the circulating pumps can be connected to the processing chambers by the tubes having comparatively short lengths so that the resistances of the flow passages are comparatively low, the processing liquids can be circulated by comparatively low power, the processing solutions leaked unexpectedly from the circulating pumps and joints in the tubes disperse in the water contained in the water tank to prevent perfectly the effluence of the processing solutions from the photographic film processing apparatus and, therefore, troublesome cleaning work is unnecessary.

Although the processing unit has the plurality of processing chambers, the processing unit can be formed in a comparatively short length, the water tank can be formed in a comparatively short length and the photographic film processing apparatus can be formed in a compact construction because the pairs of rollers defining the processing chambers are arranged along the upward concave arc of a circle. Since the film can be fed downward, can be conveyed along the U-shaped path and can be delivered upward, a long film can be easily processed. Since the two pairs of film conveying rollers are disposed respectively on the inlet side and the outlet side of each processing chamber, a short film can be stably conveyed for processing.

Furthermore, when processing a film by this photographic film processing apparatus, the film needs to be shielded from light only when feeding the film into the film guide duct and the film can be perfectly shielded from light during processing. Therefore, the photographic film processing apparatus can be operated in a daylight room by, for example, attaching a film loading dark box or a film cartridge to the opening formed in the upper portion of the film guide duct.

The film processing operation of the photographic film processing apparatus in this embodiment will be concretely described hereinafter.

The processing unit 2 of the photographic film processing apparatus has an external shape of about 150 mm in width, length and height, and the overall height of the processing unit 2 including the geared motor 18 mounted on the support plates is about 250 mm. Each of the seven processing chambers 2*a* is 80 mm in inside width and 20 mm in length, i.e., size along the direction of travel of the film F. When the film guide member 6 having the flat liquid passage of about 3 mm in thickness is placed in the processing chamber 2*a*, the effective volume of the processing chamber is about 5 $cm^3$. The inside diameter of the rubber tubes 8 connecting the circulating pumps 11 to the corresponding processing chambers 2*a* is 6 mm. The content volume of each closed circuit including the processing chamber 2*a*, the tubes 8 and the circulating pump 11 is about 30 $cm^3$. The water tank 1 is about 200 mm in width and length and about 130 μm in height. The temperature of the water W contained in the water tank 1 is to be regulated at about 33° C.

A dental superhigh-speed x-ray film that can be developed in a predetermined photographic density in about 30 sec in a stationary developing solution of an optimum concentration and can be fixed thoroughly in about 50 sec in a stationary fixing solution was processed by the photographic film processing apparatus.

The closed circuits including the processing chambers Nos. 1, 2, 4, 5 and 6 were deaerated, each of the closed circuits including the processing chambers Nos. 1 and 2 was filled up with about 30 $cm^3$ of a developing solution, and each of the closed circuits including the processing chambers Nos. 4, 5 and 6 was filled up with about 30 $cm^3$ of a fixing solution. The developing solution and the fixing solution were circulated through the processing chambers at a high flow speed of 500 mm/sec, and the exposed superhigh-speed x-ray film of 40 mm in width and 30 mm in length was conveyed through the processing chambers at a conveying speed of 2.0 mm/sec for processing.

A uniform, sharp image was formed in a processing time equal to 7/10 of the processing time necessary for processing the same x-ray film stationery processing solutions by a batch process and equal to ½ of the processing time necessary for continuously processing the same x-ray film in accord with the necessary fixing time.

When each closed circuit was replenished with 0.3 $cm^3$ of the processing solution for one film, about 500 films could be stably and satisfactorily processed.

As is apparent from the foregoing description, the photographic film processing apparatus in this embodiment is capable of uniformly, stably and quickly processing high-speed films by using a very small quantity of the developing solution that may be used for processing a single film, and the photographic film processing apparatus has a compact construction, concretely, a construction having an external shape of about 250 mm in overall height, about 200 mm in width and length.

Although each processing chamber 2*a* of the photographic film processing apparatus in this embodiment is internally provided with the film guide member 6, the sectional area and the volume of the processing chamber 2*a* may be reduced within ranges that allows the film F to travel through the processing chamber 2*a* and the processing solution L to flow through the processing chamber 2*a* across the direction of travel of the film F, and the film guide member 6 may be omitted.

The circulating pumps 11 for circulating the processing solutions L may be disposed outside the water tank 1 and may be connected to the corresponding processing chambers 2*a* by the tubes 8 penetrating the wall of the water tank 1 in a liquid-tight fashion instead of placing the circulating pumps 11 in the water tank 1. Although the liquid supply tube 10 and the air vent tank 9 are connected to the tube 8 included in each closed circuit including the processing chamber 2*a* to supply the processing solution L to the closed circuit and to deaerate the closed circuit in this embodiment, the liquid supply tube 10 and the air vent tank 9 may be connected to the circulating pump 11.

Naturally, the bodies of the film conveying rollers 3 and 3' and the sealing rollers 4 and 4' may be formed of any suitable elastic material other than rubber, such as an elastic synthetic resin, provided that the elastic material is elasticity capable of making the bodies of the rollers come into liquid-tight contact with each other and is stable against the actions of the processing solutions.

When continuously processing a superhigh-speed film requiring a fixing time longer than a developing time by the photographic film processing apparatus in this embodiment, the developing solution is circulated through the two successive processing chambers and the fixing solution is circulated through the three successive processing chambers so that the ratio in the duration of travel of the film traveling at a fixed traveling speed through the developing solution and the fixing solution is 1:1.5. However, the liquid supply system may be arranged as shown in FIGS. 4(*a*) and 4(*b*) to process continuously a normal-speed film requiring a developing reaction time and a fixing reaction time which are substantially equal to each other.

Figure 4A:
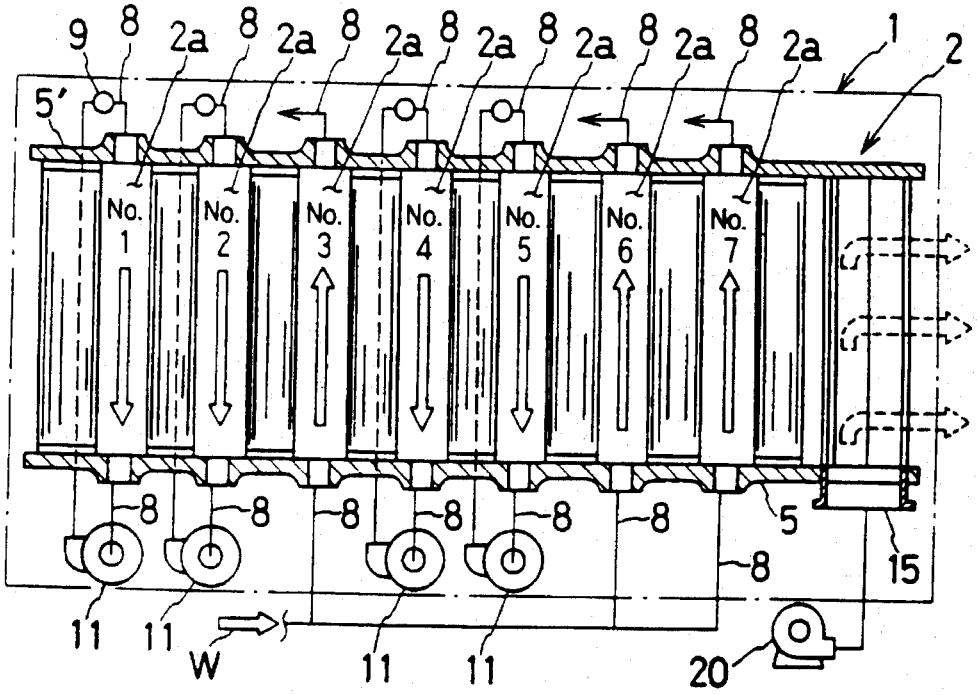
FIGS. 4(*a*) and 4(*b*) are views of assistance in explaining a liquid supply system included in a photographic film processing apparatus in a second embodiment according to the present invention.
Figure 4B:
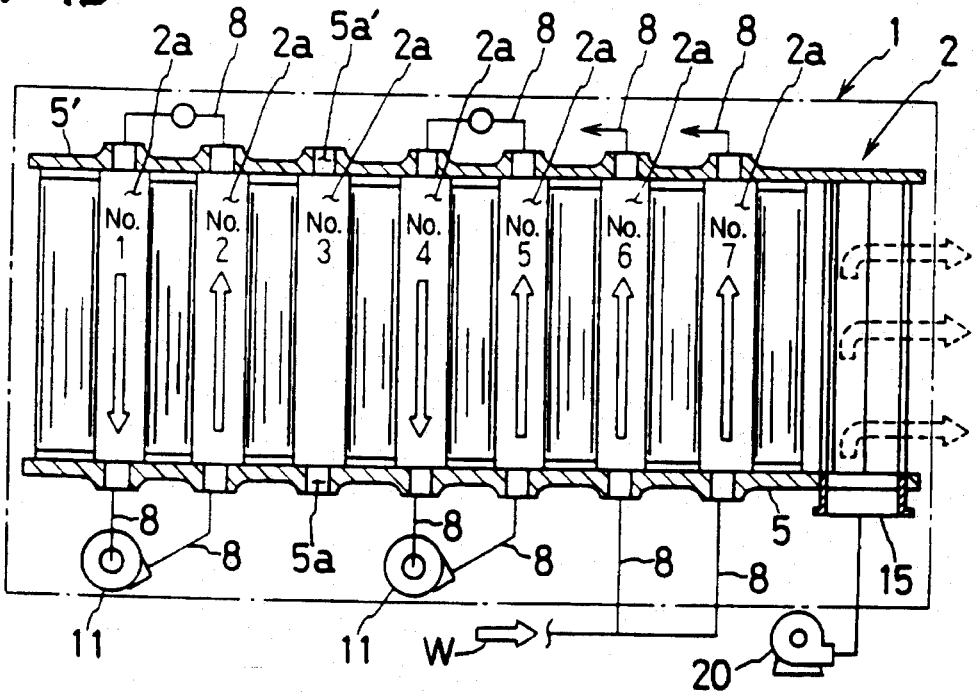

FIGS. 4(*a*) and 4(*b*) are views of assistance in explaining the liquid supply system of a photographic film processing apparatus in a second embodiment according to the present invention. Excepting the arrangement of the liquid supply system, the photographic film processing apparatus in the second embodiment is similar to the photographic film processing apparatus in the first embodiment. Therefore only the liquid supply system is illustrated, parts like or corresponding to those of the first embodiment are designated by the same reference characters, the description thereof will be omitted and only the differences will be described briefly.

Referring to FIG. 4(*a*), four processing chambers 2*a* Nos. 1, 2, 4 and 5 of a processing unit 2 are the same in constitution as those of the first embodiment and are included in independent closed circuits respectively. Three processing chambers 2*a* Nos. 3, 6 and 7 are the same in construction as those of the first embodiment and are included in open circuits respectively.

In this liquid supply system shown in FIG. 4(*a*), a developing solution is circulated through the processing chambers 21 Nos. 1 and 2 of the processing unit 2, a fixing solution is circulated through the two processing chambers 2*a* Nos. 4 and 5, fresh water W is supplied to the three processing chambers 2*a* Nos. 3, 6 and 7, hot air is blown into an air duct 15, and a normal-speed film is conveyed through the seven processing chambers along a U-shaped path for continuous processes of developing, intermediate washing, fixing, washing and drying.

In the photographic film processing apparatus in the second embodiment, the developing solution is circulated through the two adjacent processing chambers and the fixing solution is circulated through the two adjacent processing chambers. Therefore, the ratio in the duration of travel of the film through the developing solution and the fixing solution is 1:1 and the distances traveled by the film through the developing solution and the fixing solution are doubled and thereby the film can be stably processed even if the film conveying speed is doubled. Therefore, the normal-speed film that requires the developing reaction time and the fixing reaction time which are substantially the same, particularly, a long film, can be conveyed at an increased film conveying speed and hence the top-to-end time can be reduced.

Although the liquid supply system of the second embodiment has the independent closed circuits including the four processing chambers 2*a* Nos. 1, 2, 4 and 5, the two successive processing chambers 2*a* may be included in a single closed circuit and the processing solution may be circulated through the two successive processing chambers 2*a* by a single circulating pump 11 as shown in FIG. 4(*b*), because the same processing solution is circulated through the two successive processing chambers 2*a*. Furthermore, as shown in FIG. 4(*b*), the ports 5*a* and 5*a'* of the processing chamber 2*a* No. 3 may be opened into the water tank 1 to use the water supplied into the water tank 1 by the processing chamber 2*a* No. 3 for intermediate washing.

In each of the two foregoing embodiments, the processing unit has the seven processing chambers arranged on the arc of a circle and the processing solutions are used in proper combination with the seven processing chambers so that the film being continuously processed travels for different time periods in different processing solutions. However, the number of the processing chambers may be varied according to the characteristics of the film to be processed; for example, the processing chamber through which the fixing solution is to be circulated may be increased to process a superhigh-speed film requiring the fixing reaction time twice or longer than the developing reaction time.

The processing chambers may be arranged on a horizontal line if need be. When the processing chambers are arranged on a horizontal line, the pairs of film conveying rollers are driven by a chain-and-sprocket driving mechanism or a belt-and-pulley mechanism.

Figure 5A:
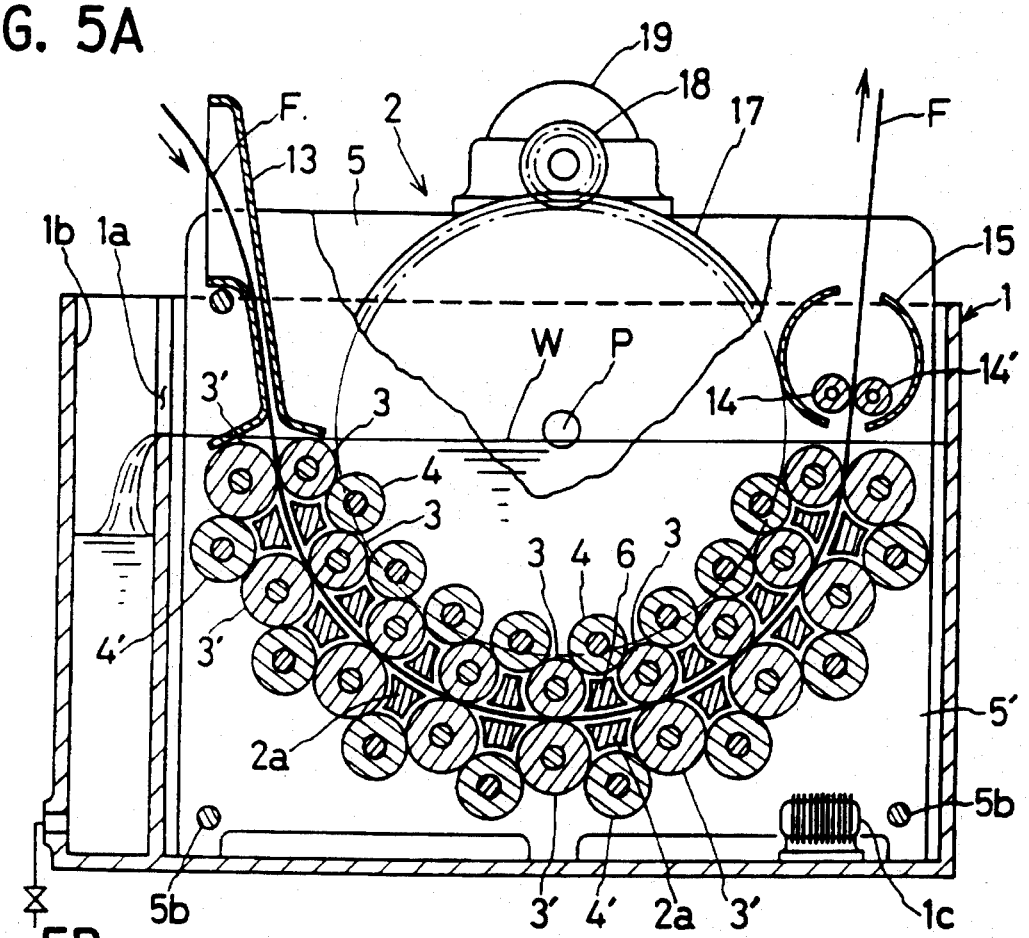
FIG. 5(*a*) is a partly cutaway front view of a photographic film processing apparatus in a third embodiment according to the present invention.
Figure 5B:
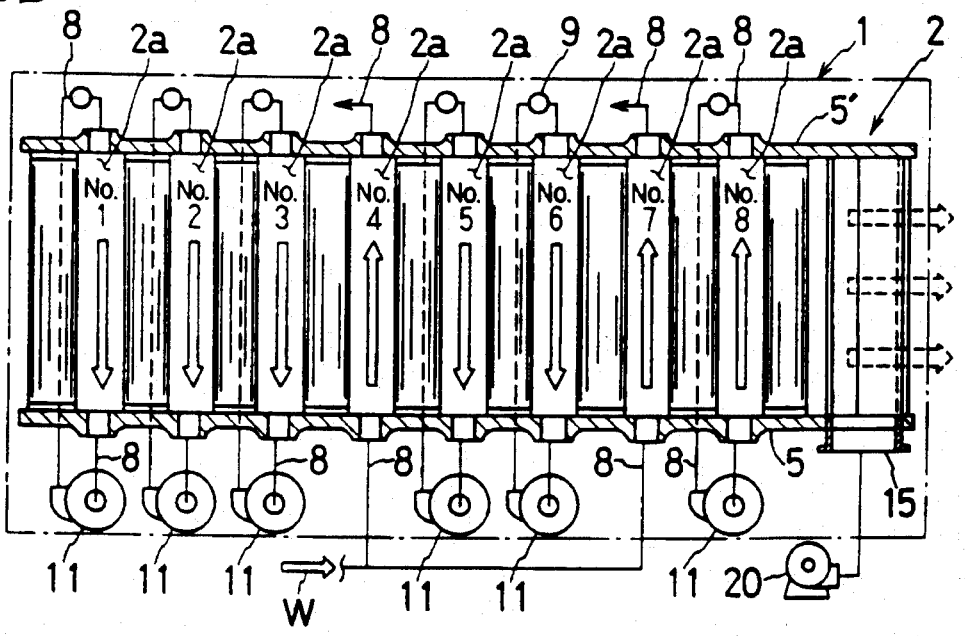

A photographic film processing apparatus in a third embodiment according to the present invention will be described with reference to FIGS. 5(*a*) and 5(*b*). FIG. 5(*a*) is a partly cutaway front view of the photographic film processing apparatus in the third embodiment and FIG. 5(*b*)

is a view of assistance in explaining a liquid supply system. Excepting the number of the processing chambers and part of the constitution of the liquid supply system of the photographic film processing apparatus, the third embodiment is similar to the photographic film processing apparatus in the first embodiment. Therefore parts like or corresponding to those of the first embodiment are designated by the same reference characters, the illustration of details will be omitted and only the differences will be described briefly.

Referring to FIG. 5(*a*), a processing unit 2 placed in a water tank 1 has nine pairs of film conveying rollers 3 and 3' and eight pairs of sealing rollers 4 and 4' disposed so as to close the spaces between the nine pairs of film conveying rollers 3 and 3'. The nine pairs of film conveying rollers 3 and 3' and the eight pairs of sealing rollers 4 and 4' are arranged along an upward concave arc of a circle having its center on an axis P, and a pair of support plates 5 and 5' are disposed on the opposite sides of the rollers to define eight successive processing chambers 2*a* Nos. 1 to 8 on the upward concave arc of the circle.

The three processing chambers 2*a* Nos. 1, 2 and 3, the two processing chambers Nos. 5 and 6, and the processing chamber 2*a* No. 8 have the same construction as those of the processing chambers of the first embodiment, and are included in independent closed circuits respectively. The processing chambers 2*a* Nos. 4 and 7, which are the same in construction as those of the first embodiment, are included in open circuits respectively. In this liquid supply system, processing solutions L are supplied to the six processing chambers 2*a* Nos. 1, 2, 3, 5, 6 and 8 and fresh water W is supplied to the processing chambers 2*a* Nos. 4 and 7.

The photographic film processing apparatus in this embodiment processes continuously, for example, Kodacolor II films produced by Kodak and equivalent color films in accordance with a processing method using Kodak Flexicolor processing agents.

A color developing solution is supplied to the processing chamber 2*a* No. 1, a bleaching solution is supplied to the two processing chambers 2*a* Nos. 2 and 3, fresh water is supplied to the processing chamber 2*a* No. 4, a fixing solution is supplied to the two processing chambers 2*a* Nos. 5 and 6, fresh water is supplied to the processing chamber 2*a* No. 7, a stabilizing solution is supplied to the processing chamber 2*a* No. 8, hot air is blown into an air duct 15 and the color film is conveyed along a U-shaped path through the eight processing chambers for continuous processing steps of color development, bleaching, intermediate washing, fixing, final washing, stabilization and provisional drying.

During the film processing operation, the temperature of the water contained in the water tank i is regulated in the range of 37.8±0.15° C. and the temperature of the hot air blown into the air duct 15 is regulated in the range of 24° to 41° C.

The processing method using the Kodak Flexicolor agents requires three minutes and fifteen seconds for color development, six minutes and thirty seconds for bleaching, three minutes and fifteen seconds for intermediate washing, six minutes and thirty seconds for fixing, three minutes and fifteen seconds for final washing, one minute and thirty seconds for stabilization, ten to twenty minutes for drying, and the standard required time for completing the processing method by stabilization is twenty-four minutes and fifteen seconds.

In the film processing operation of the photographic film processing apparatus in this embodiment to carry out the processing method using the Kodak Flexicolor processing agents, the processing solutions are used in the aforesaid combination with the processing chambers so that the ratio in the duration of travel of the film through the color developing solution, the bleaching solution, the intermediate washing water, the fixing solution, the final washing water and the stabilizing solution is 1:2:1:2:1:1.

Since the film travels through the processing chambers across the transverse flows of the processing solutions, the processing solutions wet the photosensitive layer coating the surface of the film uniformly and the reactions in the processing chambers are promoted. Accordingly, the film can be stably processed even if the film is processed for a time period shorter than the aforesaid standard required time, i.e., even if the film conveying speed is high, the respective volumes of the processing chambers and the closed circuits may be small, and the film can be continuously and quickly processed using comparatively small quantities of the processing solutions. The photographic film processing apparatus can be formed in a compact construction even if the same has a plurality of processing chambers by arranging the processing chambers on an arc of a circle, long films can be easily processed and short films can be stably conveyed for processing.

A photographic film processing apparatus in a fourth embodiment according to the present invention will be described hereinafter with reference to FIGS. 6 and 7.

Figure 6:
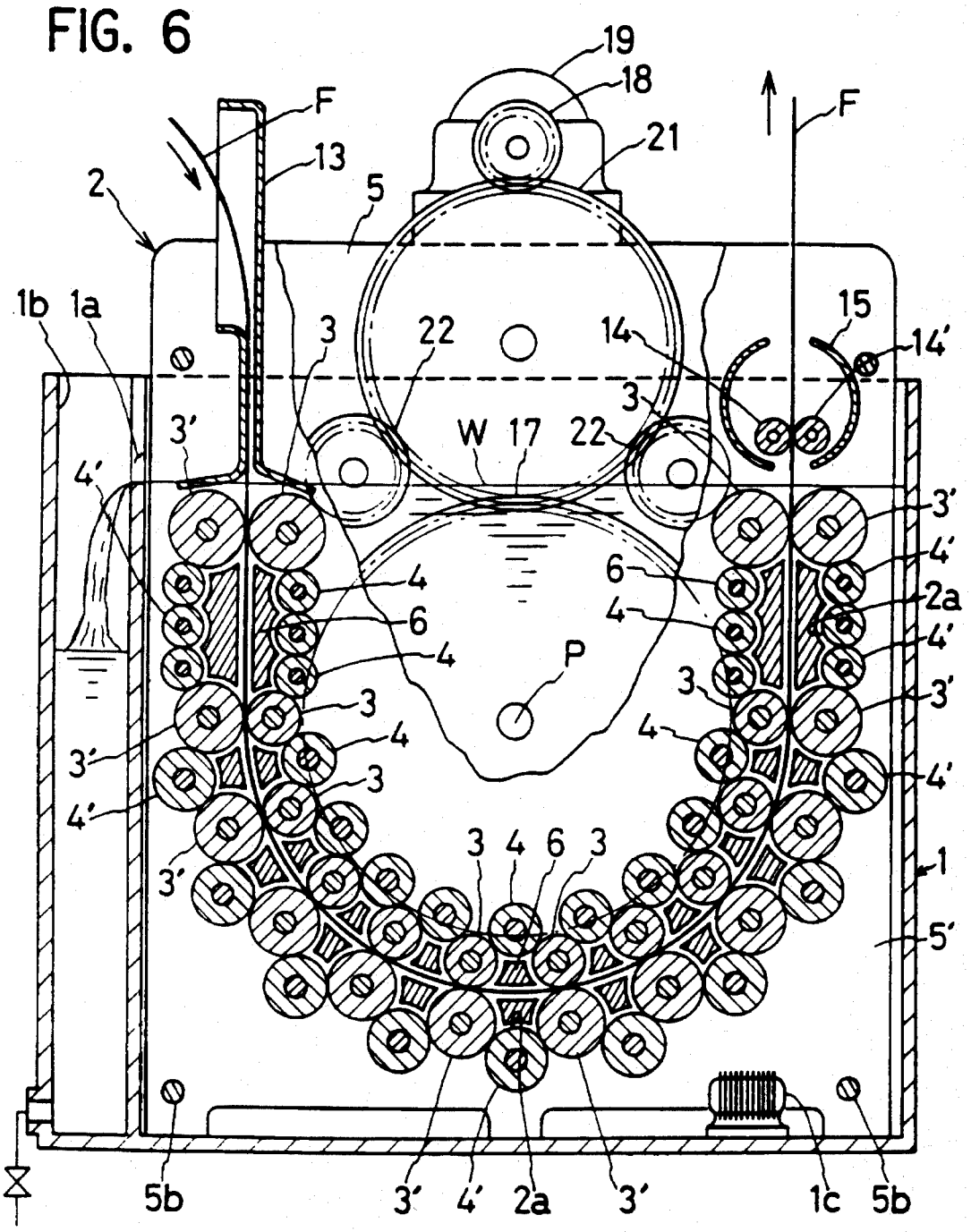
FIG. 6 is a partly cutaway front view of a photographic film processing apparatus in a fourth embodiment according to the present invention.
Figure 7:
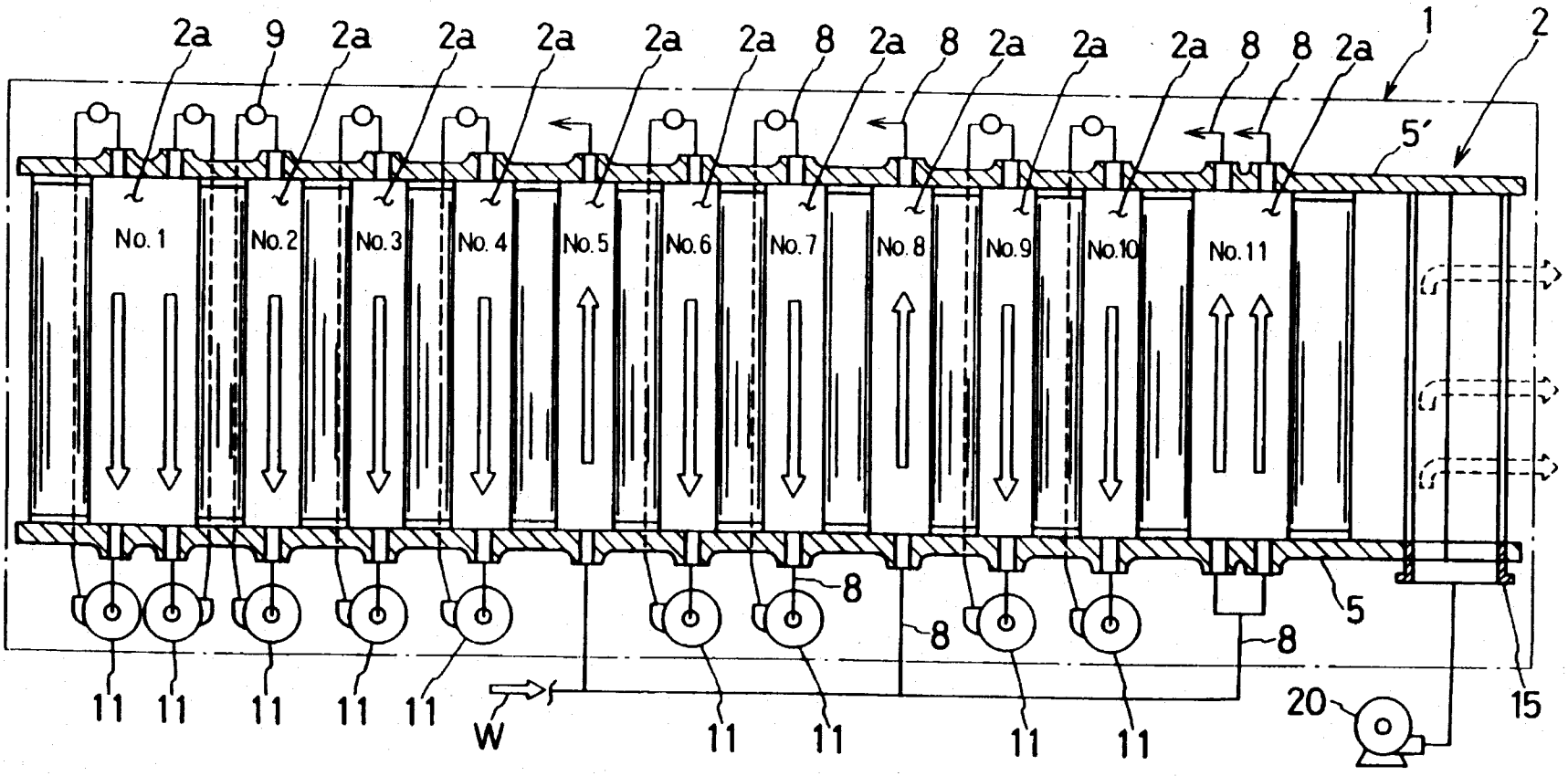
FIG. 7 is a view of assistance in explaining a liquid supply system included in the photographic film processing apparatus in the fourth embodiment.
Figure 8A:
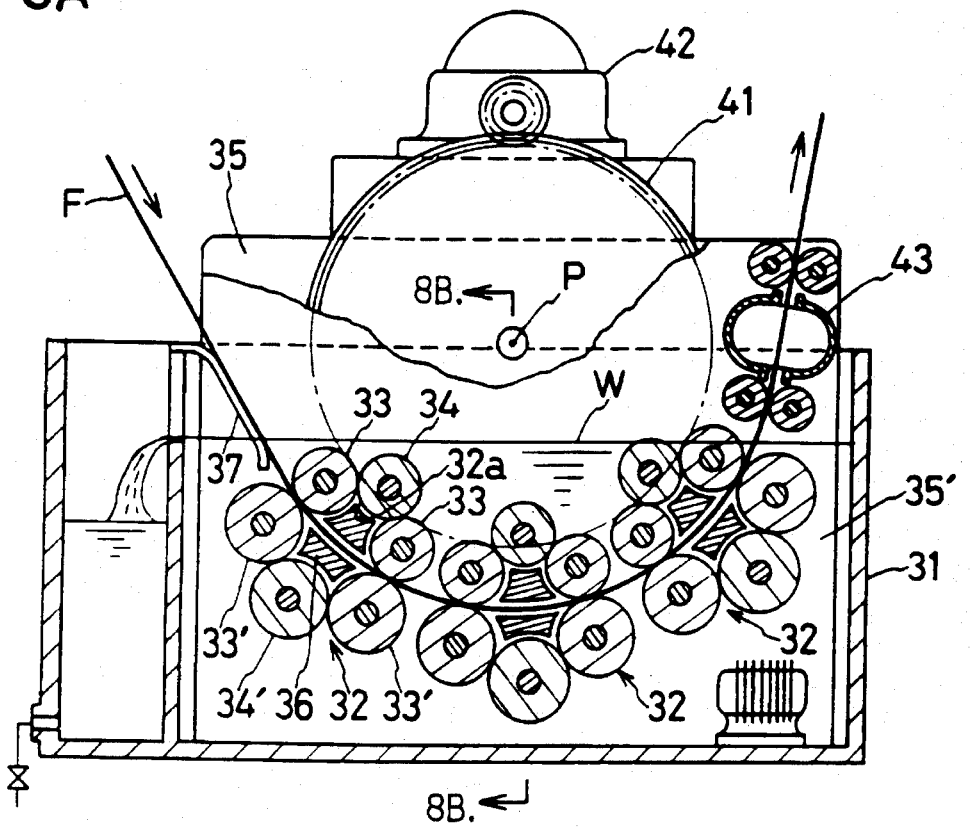
FIGS. 8(*a*) and 8(*b*) are view of assistance in explaining a photographic film processing apparatus in a first embodiment according to an invention disclosed in an earlier patent application.
Figure 8B:
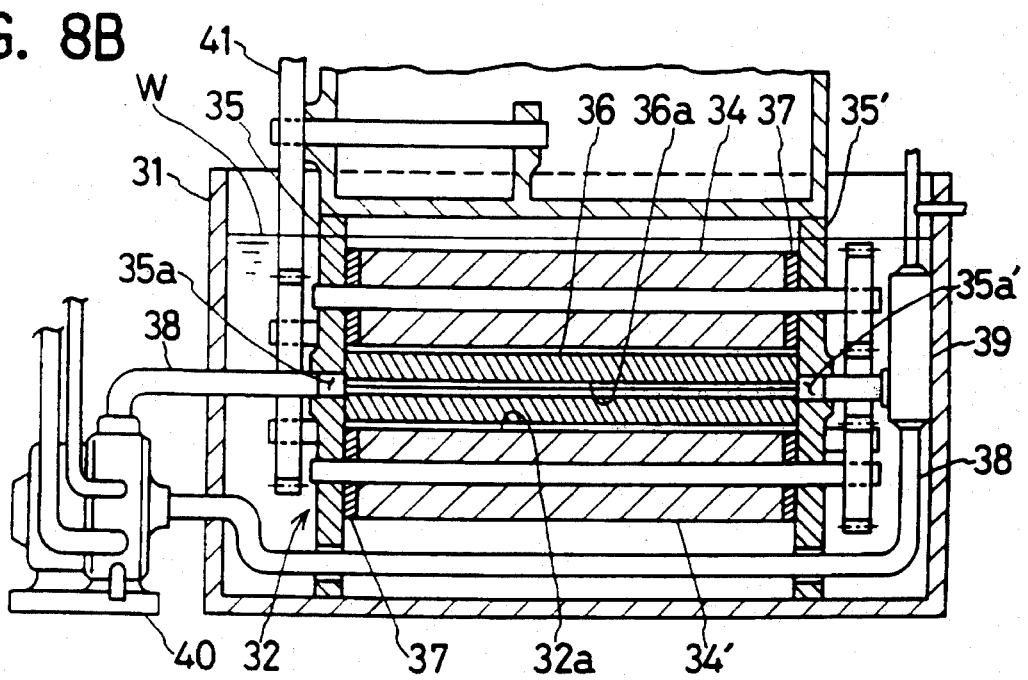

FIG. 6 is a partly cutaway front view of the photographic film processing apparatus in this embodiment and FIG. 7 is a view of assistance in explaining the liquid supply system of the photographic film processing apparatus. Excepting the number of processing chambers, part of the arrangement of the components, and part of the constitution of a driving system and a liquid supply system, the photographic film processing apparatus in this embodiment is basically similar to the photographic film processing apparatus in the third embodiment. Therefore, parts like or corresponding to those of the third embodiment are designated by the same reference characters, the illustration of details will be omitted and only the differences will be described briefly.

Referring to FIG. 6, a processing unit 2 placed in a water tank 1 has twelve pairs of film conveying rollers 3 and 3' and fifteen pairs of sealing rollers 4 and 4' disposed so as to close spaces between the twelve pairs of film conveying rollers 3 and 3'. The twelve pairs of film conveying rollers 3 and 3' and the fifteen pairs of sealing rollers 4 and 4' are arranged along a U-shaped line comprising an upward concave arc of a circle having its center on an axis P, and lines tangentially extending from the opposite ends of the arc of the circle respectively, and a pair of support plates 5 and 5' are placed on the opposite sides of the rollers to define processing chambers 2*a* Nos. 1 to 11 successively arranged on the U-shaped line.

The ten pairs, i.e., the second to the eleventh pair, of film conveying rollers 3 and 3' are arranged along the circular section of the U-shaped line, and each of the spaces between the adjacent pairs of the film conveying rollers 3 and 3' is closed by the pair of sealing rollers 4 and 4' to form the nine processing chambers 2*a* Nos. 2 to 10 successively on the circular section of the U-shaped line. The diameter of the top film conveying rollers 3 of the second to the eleventh pair, like that of the top film conveying rollers of the first embodiment, is smaller than that of the bottom film conveying rollers 3' of the same pairs, and the diameter of the top sealing rollers 4, like that of the top sealing rollers of the first embodiment, is smaller than that of the bottom sealing rollers 4'.

The first and the twelfth pair of film conveying rollers 3 and 3' are disposed along the straight sections of the U-shaped line respectively, and each of the spaces between the first and the second pairs of film conveying rollers 3 and 3' and between the eleventh and the twelfth pair of film conveying rollers 3 and 3' is closed by three pairs of sealing rollers 4 and 4' of the same diameter to form the processing chamber 2*a* Nos. 1 and 2 on the straight sections, respectively, of the U-shaped line. The lengths along the film conveying direction of the processing chambers 2*a* Nos. 1 and 11 are about 2.5 times and about twice, respectively, that of the rest of the processing chambers 2*a*.

The second to the eleventh pair of film conveying rollers 3 and 3' are driven for synchronous rotation by a geared motor 19 through a gear train comprising a pinion 18 mounted on the output shaft of the geared motor 19, an intermediate spur gear in engagement with the pinion 18 and a driving spur gear 17 supported for rotation about the axis P and in engagement with the intermediate spur gear 21. The first and the twelfth pair of film conveying rollers 3 and 3' are driven for synchronous rotation by two intermediate spur gears 22 in engagement with the intermediate spur gear 21 respectively. The sealing rollers 4 and 4' are driven frictionally for synchronous rotation by the adjacent pairs of film conveying rollers 3 and 3'.

As shown in FIG. 7, the three processing chambers 2*a* Nos. 2 to 4, the two processing chambers 2*a* Nos. 6 and 7 and the two processing chambers 2*a* Nos. 9 and 10, like those of the first embodiment, are included in independent closed circuits respectively. The processing chambers 2*a* Nos. 5 and 8, like those of the first embodiment, are included in open circuits respectively. Since the respective lengths along the film conveying direction of the processing chambers 2*a* Nos. 1 and 11 are longer than that of the rest of the processing chambers 2*a*, two pairs of ports 5*a* and 5*a'* are formed in the support plates 5 and 5' for each of the processing chambers 2*a* Nos. 1 and 11 to circulate a processing solution L through the processing chamber 2*a* No. 1 through two closed circuits and to supply fresh water W into the processing chamber 2*a* No. 11 through branch tubes branched from a feed tube 8 and connected to the two ports 5*a* in order that the processing solution L and the fresh water W will flow in uniform flows through the processing chambers 2*a* Nos. 1 and 11 respectively. The liquid supply system thus formed supplies processing solutions L to the eight processing chambers 2*a* Nos. 1 to 4, 6, 7, 9 and 10, and fresh water W to the three processing chambers 2*a* Nos. 8 and 11.

The photographic film processing apparatus in this embodiment processes continuously, for example, Kodacolor X films of Kodak and equivalent color films according to a processing method using Kodak Process C-22.

A color developing solution is supplied to the two processing chambers 2*a* Nos. 1 and 2, a stopping solution is supplied to the processing chamber No. 3, a hardening solution is supplied to the processing chamber 2*a* No. 4, fresh water is supplied to the processing chamber 2*a* No. 5, a bleaching solution is supplied to the two processing chambers 2*a* Nos. 6 and 7, fresh water is supplied to the processing chamber 2*a* No. 8, a fixing solution is supplied to the two processing chambers 2*a* Nos. 9 and 10, fresh water is supplied to the processing chamber 2*a* No. 11, hot air is blown into an air duct 15, and the color film is conveyed along the U-shaped path through the eleven processing chambers for continuous steps of color development, stopping, hardening, first intermediate washing, bleaching, second intermediate washing, fixing, final washing, dewatering and provisional drying.

The temperature of the water contained in the water tank 1 is regulated in the range of 24°±0.3° C. and the temperature of the hot air blown into the air duct 15 is regulated to temperatures not higher than 43° C. The flow speed of the bleaching solution circulated through the processing chambers 2*a* Nos. 6 and 7 is controlled at a comparatively low speed to avoid excessive bleaching.

The processing method using Kodak Process C-22 requires fourteen minutes for color development, four minutes for each of stopping, hardening and first intermediate washing, six minutes for bleaching, four minutes for second intermediate washing, eight minutes for each of fixing and final washing and one minute for dewatering, and the standard required time for completing the processing method by stabilization is fifty-three minutes.

In the film processing operation of the photographic film processing apparatus in this embodiment to carry out the processing method using Kodak Process C-22, the processing solutions are used in the aforesaid combination with the processing chambers so that the ratio in the duration of travel of the film through the color developing solution, the fixing solution, the hardening solution, the first intermediate washing water, the bleaching solution, the second intermediate washing water, the fixing solution and the final washing water is 3.5:1:1:1:2:1:2:2.

Since the film travels through the processing chambers across the transverse flows of the processing solutions, the processing solutions wet the photosensitive layer coating the surface of the film uniformly and the reactions in the processing chambers are promoted. Accordingly, the film can be stably processed even if the film is processed for a time period shorter than the aforesaid standard required time, i.e., even if the film conveying speed is high, the respective volumes of the processing chambers and the closed circuits may be small, and the film can be continuously and quickly processed using comparatively small quantities of the processing solutions. The photographic film processing apparatus can be formed in a compact construction even if the same has a plurality of processing chambers by arranging the plurality of processing chambers on an arc of a circle, long films can be easily processed and short films can be stably conveyed for processing.

In the photographic film processing apparatuses in the foregoing four embodiments, the same processing solution is supplied to the adjacent processing chambers, a specified processing chamber having a length along the film conveying direction longer than those of the rest of the processing chambers is formed by arranging odd pairs of sealing rollers more than one pair of sealing rollers between the two adjacent pairs of film conveying rollers at specified positions, and the processing solutions are used in proper combination with the processing chambers so that the film being continuously processed travels for different time periods in different processing solutions. The specified processing chamber having a length along the film conveying direction different from those of the rest of the processing chambers may be formed between the two adjacent pairs of film conveying rollers at specified positions by arranging sealing rollers having diameters different from those of the rest of the sealing rollers between the two adjacent pairs of film conveying rollers at specified positions, which is effective particularly for the fine adjustment of the duration of travel of the film through a specified processing solution.

The present invention is not limited in its practical application to the foregoing four embodiments specifically described herein and modifications and changes may be made therein without departing from the gist of the invention. The number of the processing chambers of the processing unit, the lengths of the processing chambers along the film conveying direction and the combination of the processing liquids with the processing chambers may be changed to process the film for different time periods in different processing solutions for continuous processing. Thus, films of various types to be processed by a series of steps requiring different reaction times respectively can be stably, continuously and quickly processed.

As is apparent from the foregoing description, the photographic film processing apparatus in accordance with the present invention having the processing unit placed in the water tank and provided with the plurality of processing chambers is capable of easily shielding the film to be processed from light, of properly determining processing times for which the film traveling at a fixed traveling speed is to be processed in the processing chambers for film processing steps respectively and of uniformly, stably, continuously and quickly processing various types of films including superhighspeed speed films requiring a plurality of film processing steps requiring different reaction times respectively, normal-speed films and color films using small quantities of processing solutions. Furthermore, the photographic film processing apparatus has a compact construction, requires low power for operation and does not require troublesome cleaning work.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A photographic film processing apparatus comprising:

a water tank, and a processing unit having a plurality of processing chambers of a small volume successively arranged along a film conveying direction, disposed in the water tank and comprising:

a plurality of pairs of film conveying rollers arranged at predetermined small intervals;

one pair or odd pairs of sealing rollers disposed between two adjacent pairs of the film conveying rollers, a top sealing roller of the pair of sealing rollers or top sealing rollers of the odd pairs of sealing rollers being arranged so as to connect respective top film conveying rollers of the two adjacent pairs of film conveying rollers, and a bottom sealing roller of the pair of sealing rollers or bottom sealing rollers of the odd pairs of sealing rollers being arranged so as to connect respective bottom film conveying rollers of the two adjacent pairs of film conveying rollers; and a pair of support plates being disposed on opposite sides of the pairs of film conveying rollers and the pairs of sealing rollers, respectively, so as to define the processing chambers of a small volume arranged successively along a film conveying direction together with the pairs of film conveying rollers and the pairs of sealing rollers;

wherein:

the bodies of the film conveying rollers and the sealing rollers are formed of elastic materials;

one of the pair of support plates is provided with inlet ports opening into the processing chambers respectively; and the other support plate is provided with outlet ports opening into the processing chambers respectively.

2. A photographic film processing apparatus according to claim 1, wherein a film guide member having a flat liquid passage communicating with the inlet port and the outlet port formed in the pair of support plates, a slit facing a contact line between the top film conveying roller and the bottom film conveying roller of one of the two adjacent pairs of film conveying rollers, and another slit facing a contact line between the top film conveying roller and the bottom film conveying roller of the other pair of film conveying rollers is disposed in each of the processing chambers so as to be separated from the film conveying rollers and the sealing rollers.

3. A photographic film processing apparatus according to claim 1, wherein the pairs of film conveying rollers and the pairs of sealing rollers are arranged along a circular line having a shape of an upward concave arc of a circle or a U-shaped line comprising an upward concave arc of a circle and lines tangentially extending from opposite ends of the upward concave arc of a circle respectively, the processing chambers are arranged successively on the circular or the U-shaped line, a diameter of the top film conveying roller of each pair of film conveying rollers is smaller than that of the bottom film conveying roller of the same pair of film conveying rollers, and a diameter of the top sealing roller of each pair of sealing rollers is smaller than that of the bottom sealing roller of the same pair of sealing rollers.

4. A photographic film processing apparatus according to claim 1, wherein at least one of the processing chambers of the processing unit is connected to a washing water supply means through the inlet port and a tube connected to the inlet port and to the water tank through the outlet port and a tube connected to the outlet port to form an open circuit, each of the rest of the processing chambers is connected to a circulating pump through the inlet port, a tube connected to the inlet port, the outlet port and a tube connected to the outlet port to form a closed circuit, and a processing liquid supply tube and an air vent tank are connected to the tube or the circulating pump.

5. A photographic film processing apparatus according to claim 4, wherein the circulating pump is disposed near the outlet port of one of the support plates in the water tank, the discharge port of the circulating pump is connected to the inlet port of the other support plate by a tube extended under or around the processing unit, and the suction port of the circulating pump is connected to the outer port of the former support plate by a tube extended along the shortest route.

* * * * *

UNITED STATES PATENT AND TRADEMARK OFFICE

CERTIFICATE OF CORRECTION

PATENT NO. : 5,528,329

DATED : June 18, 1996

INVENTOR(S) : RYOSAKU SAWADA ET AL

It is certified that error appears in the above-indentified patent and that said Letters Patent is hereby corrected as shown below:

In column 6, line 29, delete "10".

In column 9, line 17, after "FIG." (second occurrence) insert --1(a);--.

In column 14, line 42, change "130 μm" to --130 mm--.

In column 17, line 51, change "i" to --1--.

In column 21, line 21, delete "speed".

Signed and Sealed this

Twenty-fifth Day of March, 1997

*Attest:*

*Attesting Officer*

Bruce Lehman

BRUCE LEHMAN

*Commissioner of Patents and Trademarks*